US006278348B1

(12) United States Patent
Usami

(10) Patent No.: US 6,278,348 B1
(45) Date of Patent: Aug. 21, 2001

(54) DEFLECTION YOKE

(75) Inventor: Yoshihiko Usami, Greensburg, PA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

(21) Appl. No.: 09/443,762

(22) Filed: Nov. 19, 1999

(51) Int. Cl.[7] ..... H01F 7/00; H01F 1/00

(52) U.S. Cl. ..... 335/210; 335/213; 313/440

(58) Field of Search ..... 335/210–223; 313/440–441

(56) References Cited

U.S. PATENT DOCUMENTS

| | | | | |
|---|---|---|---|---|
| 4,376,273 | * | 3/1983 | Shisler et al. | 335/213 |
| 5,418,422 | * | 5/1995 | Vink et al. | 313/440 |
| 5,818,159 | * | 10/1998 | Dossot et al. | 313/440 |
| 5,838,099 | | 11/1998 | Hichiwa et al. . | |

* cited by examiner

*Primary Examiner*—Lincoln Donovan
*Assistant Examiner*—Tuyen T. Nguyen
(74) *Attorney, Agent, or Firm*—Mayer Fortkort & Williams PC; Michael P. Fortkort; Karin L. Williams

(57) ABSTRACT

A deflection yoke includes a horizontal coil having a modified wire route in the horizontal coil at one or more predetermined points, which are termed herein turning points, in the middle of the coil which is generating the main magnetic field. A deflection yoke includes a horizontal coil with a neck side and a funnel side, and a window defined by a wire route. The window is disposed in the horizontal coil and has a substantially rectangular shape when viewed in cross section. The wire defines an outline of the window. The wire includes a first portion and a second portion. The wire originates at a first predetermined angle on the neck side of the horizontal coil, and splits into the first and second portions at a first turning point. The first portion is rerouted at a second predetermined angle on the funnel side of the horizontal coil. The second portion turns away from the first portion at an approximately right angle. The second portion includes a second turning point disposed at a third predetermined angle at which second turning point the second portion turns so that the second portion is rerouted at a fourth predetermined angle on the funnel side. A method is disclosed for controlling convergence error in a deflection yoke. First, a wire in the horizontal coil is split into a first portion and a second portion at a predetermined location along the wire originating at a predetermined winding angle on a neck side of the horizontal coil. Second, a window is created in the horizontal coil. Finally, a wire route is created in the second portion of the split wire that runs perpendicular to the first portion for a predetermined length and runs substantially parallel to the first portion after the predetermined length by turning at a turning point towards a funnel side of the horizontal coil so that the second portion terminates on the funnel side at a predetermined funnel side angle.

13 Claims, 8 Drawing Sheets

DEFLECTION YOKE

BACKGROUND OF THE INVENTION

The present invention relates generally to cathode ray tubes, and more particularly to a cathode ray tube including a saddle type of horizontal coil used in a deflection yoke.

An important aspect of performance for a television monitor is its ability to correctly align the individual color components (red, green and blue). Mis-convergence describes how far apart the three electron beams spread from one another within a pixel. Ideally, the beam hits all three dots in the group without hitting any adjacent groups. Mis-convergence is a quantitative measurement of the lack of convergence of the three electron beams. From a viewer's perspective, in the case of mis-convergence the resulting image will have a shadowed appearance.

A deflection yoke is used to control the convergence of the three electron beams (red, green and blue) in a cathode ray tube (CRT) by changing the winding distribution in the horizontal and vertical coils to compensate for mis-convergence. For example, U.S. Pat. No. 5,838,099 discloses one such deflection yoke, which can be seen in FIG. 2, which depicts a perspective view showing a pair of saddle type horizontal deflection coils.

When correcting mis-convergence, in general there are four parameters that affect convergence as controlled by the horizontal coil of a deflection yoke—PQV, S1, S2 and S3. Of these, PQV is the main control parameter for the deflection yoke. The other parameters S1, S2 and S3 are critical to correct the mis-convergence in the middle screen area.

FIGS. 1*a–d* depict the plus pattern on the CRT screen, in which FIG. 1*a* depicts the PQV related mis-convergence; FIG. 1*b* depicts the S1 related mis-convergence; FIG. 1*c* depicts the S2 related mis-convergence; and FIG. 1*c* depicts the S3 related mis-convergence. As evident in FIG. 1*a*, the PQV related mis-convergence concerns the mis-convergence of the red and blue electron beams at the edges of the screen. In contrast, the S3 related mis-convergence concerns the mis-convergence of the red and blue electron beams at the middle of the horizontal edges. Similarly, the S1 and S2 related mis-convergence concern the edges and middle of the screen, respectively. The relationships between the various parameters are given below:

$$\Delta S1 = S1 - \frac{PQV}{2}$$

$$\Delta S2 = S2 - \frac{PQV}{4}$$

$$\Delta S3 = S3 - \frac{PQV}{2}$$

Normally, one adjusts the convergence error by using the horizontal coil, which creates a pincushion type magnetic field. Using the horizontal coil, the mis-convergence termed PQV, XH (which is the edge of X-axis horizontal convergence error) and the mis-convergence termed HCR (which is the same location of XH, but a different type of convergence error) are corrected to zero. Of course, S1, S2 and S3 are simultaneously controlled to within desired values by the magnetic field generated by the horizontal coil.

Viewer preferences for larger and flatter television screens requires cathode ray tubes with wider deflection angles. As the screen in a CRT becomes larger and flatter, and as the deflection angle becomes correspondingly wider, it becomes more difficult to adjust the mis-convergence using conventional methods. In particular, in such CRT's it is difficult to correct the mis-convergence in the middle section of the screen.

In an attempt to overcome the problem of correcting the mis-convergence in the middle of the screen, a correction device has been installed on the deflection yoke. However, this complicates the manufacturing process and requires additional components. Moreover, the correction resulting from this device is not entirely sufficient for the larger CRT's.

To correct the convergence error, it is necessary to provide a strong magnetic field (i.e., a strong pincushion-type patterned distorted magnetic field) using the horizontal coil. Basically, the main parameter PQV is relatively easy to correct. However, the parameters S1, S2 and S3 (which are termed middle of the convergence) cannot be adjusted using only the horizontal coil in the conventional manner. Consequently, the mis-convergence related to these parameters remains out of the desired range. To correct this middle convergence error it is necessary to provide a strong magnetic field.

FIGS. 3*a–d* depict a conventional method for correcting this convergence error, including middle area convergence error. To do so, one places a small magnet on the deflection yoke front portion, which can be seen in FIGS. 3*b–d*. In practice, however, it is too difficult to correct convergence error that consists of combinations of S1, S2 and S3, e.g., S1 with S2, or S2 with S3, or S1 with S3 using this method. Moreover, this method is also problematic from a standpoint of geometry in that the design of the horizontal coil should be symmetrical to create predictable magnetic fields.

Another conventional technique uses an additional correction device placed on the deflection yoke, as seen in FIG. 4. Unfortunately, this technique increases the cost and decreases the reliability. Furthermore, this design requires specific fine tuning and an engineering design.

FIGS. 5*a–c* depict one such additional correction device in more detail. FIG. 5*a* depicts the correction device in top view and FIG. 5*b* depicts the correction device in side view. The device includes a circuit, as set forth in FIG. 5*c*. The convergence parameters PQV, S1, S2 and S3 before the addition of the correction device are depicted in FIG. 5*d*. After addition of the correction device, the improvements in the convergence is shown in FIG. 5*e*. As apparent in FIG. 5*e*, the combination of the various mis-convergences is difficult to correct using such a correction device.

The present invention is therefore directed to the problem of developing a method and apparatus for adjusting the mis-convergence in the middle area of a cathode ray tube without requiring the use of a dedicated correction device, which method and apparatus can be employed in larger and flatter CRT screens.

SUMMARY OF THE INVENTION

The present invention solves this problem by modifying a wire route in the horizontal coil (also called saddle type) at one or more predetermined points (which are termed herein the turning points) in the middle of the coil which is generating the main magnetic field.

According to one aspect of the present invention, a deflection yoke includes a horizontal coil with a neck side and a funnel side, and a window defined by a wire route. The window is disposed in the horizontal coil and has a substantially rectangular shape when viewed in cross section. The wire defines an outline of the window. The wire includes a first portion and a second portion. The wire originates at a first predetermined angle on the neck side of the horizontal coil, and splits into the first and second portions at a first turning point. The first portion is rerouted at a second predetermined angle on the funnel side of the horizontal coil. The second portion turns away from the first portion at an approximately right angle. The second portion includes a second turning point disposed at a third predetermined angle at which second turning point the second portion turns so that the second portion is rerouted at a fourth predetermined angle on the funnel side.

According to another aspect of the present invention, in the above deflection yoke, the first predetermined angle lies within a range from approximately sixty-five degrees (65°) to approximately seventy-six degrees (76°) when measured from a horizontal axis through a cross-section of the horizontal coil.

According to another aspect of the present invention, in the above deflection yoke, the second predetermined angle lies within a range from approximately sixty-five degrees (65°) to approximately seventy-six degrees (76°) when measured from a horizontal axis through a cross-section of the horizontal coil.

According to another aspect of the present invention, in the above deflection yoke, the third predetermined angle is approximately forty degrees (40°) when measured from a horizontal axis through a cross-section of the horizontal coil.

According to another aspect of the present invention, in the above deflection yoke, the fourth predetermined angle lies within a range from approximately fifty-six degrees (56°) to approximately seventy-six degrees (76°) when measured from a horizontal axis through a cross-section of the horizontal coil.

According to another aspect of the present invention, in the above deflection yoke, the first turning point is disposed at a location on the first portion of approximately forty-six percent (46%) to approximately fifty-five percent (55%) of a total length of the first portion from the neck side.

According to another aspect of the present invention, in the above deflection yoke, the second turning point is disposed at a location on the second portion of approximately fifty-seven percent (57%) to approximately sixty-four percent (64%) of a total length of the second portion from the neck side.

According to another aspect of the present invention, the above deflection yoke also includes a first pin around which the second portion is wound thereby establishing the first turning point.

According to another aspect of the present invention, the above deflection yoke also includes a second pin around which the second portion is wound thereby establishing the second turning point.

According to yet another aspect of the present invention, a deflection yoke includes a horizontal coil with a funnel side, a neck side and a window defined by a wire route. The window is disposed in the horizontal coil. The wire defines an outline of the window. The wire includes a first portion and a second portion. The wire originates at a first predetermined angle on the neck side of the horizontal coil, and splitting into the first and second portions at a first turning point. The first portion is rerouted at a second predetermined angle on the funnel side of the horizontal coil. The second portion turns away from the first portion at an approximately right angle. The second portion includes a second turning point disposed at a third predetermined angle at which turning point the second portion turns so that the second portion is rerouted at a fourth predetermined angle on the funnel side.

According to another aspect of the present invention, in the above deflection yoke, the first predetermined angle lies within a range from approximately thirty degrees (30°) to approximately forty degrees (40°) when measured from a horizontal axis through a cross-section of the horizontal coil.

According to another aspect of the present invention, in the above deflection yoke, the second predetermined angle lies within a range from approximately thirty degrees (30°) to approximately forty degrees (40°) when measured from a horizontal axis through a cross-section of the horizontal coil.

According to another aspect of the present invention, in the above deflection yoke, the third predetermined angle is approximately sixty degrees (60°) when measured from a horizontal axis through a cross-section of the horizontal coil.

According to another aspect of the present invention, in the above deflection yoke, the fourth predetermined angle lies within a range from approximately fifty-six degrees (56°) to approximately sixty degrees (60°) when measured from a horizontal axis through a cross-section of the horizontal coil.

According to yet another aspect of the present invention, a method for controlling convergence error in a deflection yoke includes at least three steps. First, the method includes the step of splitting a wire in the horizontal coil into a first portion and a second portion at a predetermined location along the wire originating at a predetermined winding angle on a neck side of the horizontal coil. Second, the method includes the step of creating a window in the horizontal coil having a substantially trapezoidal cross-section. Finally, the method includes the step of creating a wire route in the second portion of the split wire that runs perpendicular to the first portion for a predetermined length and runs substantially parallel to the first portion after the predetermined length by turning at a turning point towards a funnel side of the horizontal coil so that the second portion is related on the funnel side at a predetermined funnel side angle.

According to another aspect of the present invention, in the above method, the predetermined winding angle lies within a range from approximately sixty-five degrees (65°) to approximately seventy-six degrees (76°) when measured from a horizontal axis through a cross-section of the horizontal coil.

According to another aspect of the present invention, in the above method, the predetermined funnel side angle lies within a range from approximately fifty-six degrees (56°) to approximately seventy-six degrees (76°) when measured from a horizontal axis through a cross-section of the horizontal coil.

According to another aspect of the present invention, in the above method, the predetermined location lies within a range of approximately forty-six percent (46%) to approximately fifty-five percent (55%) of a total length of the first portion from the neck side.

According to another aspect of the present invention, in the above method, the turning point is disposed at a location on the second portion of approximately fifty-seven percent (57%) to approximately sixty-four percent (64%) of the second portion from the neck side.

According to another aspect of the present invention, the above method also includes the step of splitting the wire at a first pin around which the second portion is wound.

According to another aspect of the present invention, the above method also includes the step of winding the second portion around a second pin thereby establishing the turning point.

According to another aspect of the present invention, in the above method, the predetermined winding angle lies within a range from approximately thirty degrees (30°) to approximately forty degrees (40°) when measured from a horizontal axis through a cross-section of the horizontal coil.

According to another aspect of the present invention, in the above method, the predetermined funnel side angle lies within a range from approximately fifty-six degrees (56°) to approximately sixty degrees (60°) when measured from a horizontal axis through a cross-section of the horizontal coil.

DETAILED DESCRIPTION

The present invention achieves optimum middle convergence without requiring installation of a separate correction device. To accomplish this, the present invention provides one or more turning points on the horizontal coil.

Figure 1A:
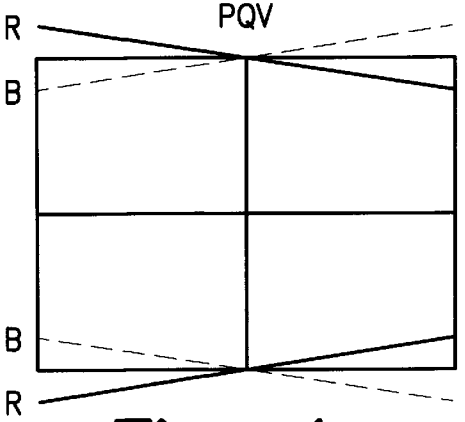
Fig. 1a Prior Art
FIGS. 1*a–d* depict four various types of mis-convergence-related parameters PQV, S1, S2 and S3, respectively, which must be considered when correcting convergence in the middle screen area of the cathode ray tube (CRT) as depicted on the CRT screen.
Figure 1B:
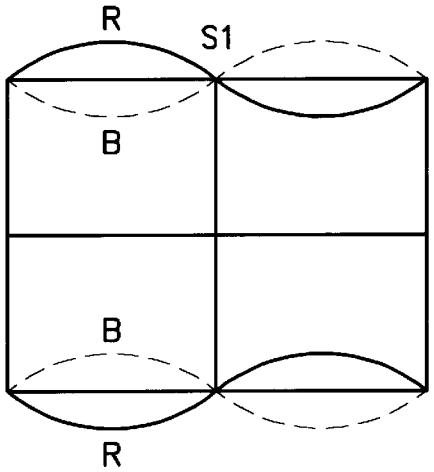
Fig. 1b Prior Art
Figure 1C:
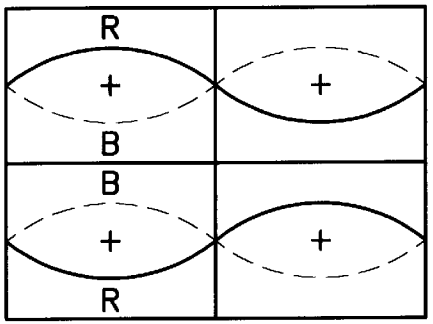
Fig. 1c Prior Art
Figure 1D:
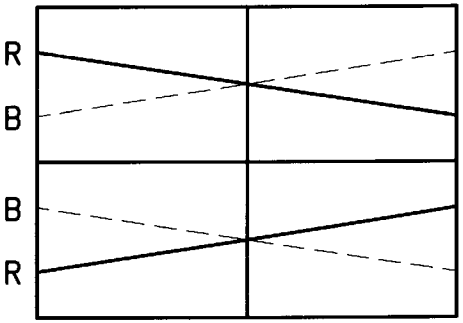
Fig. 1d Prior Art
Figure 2:
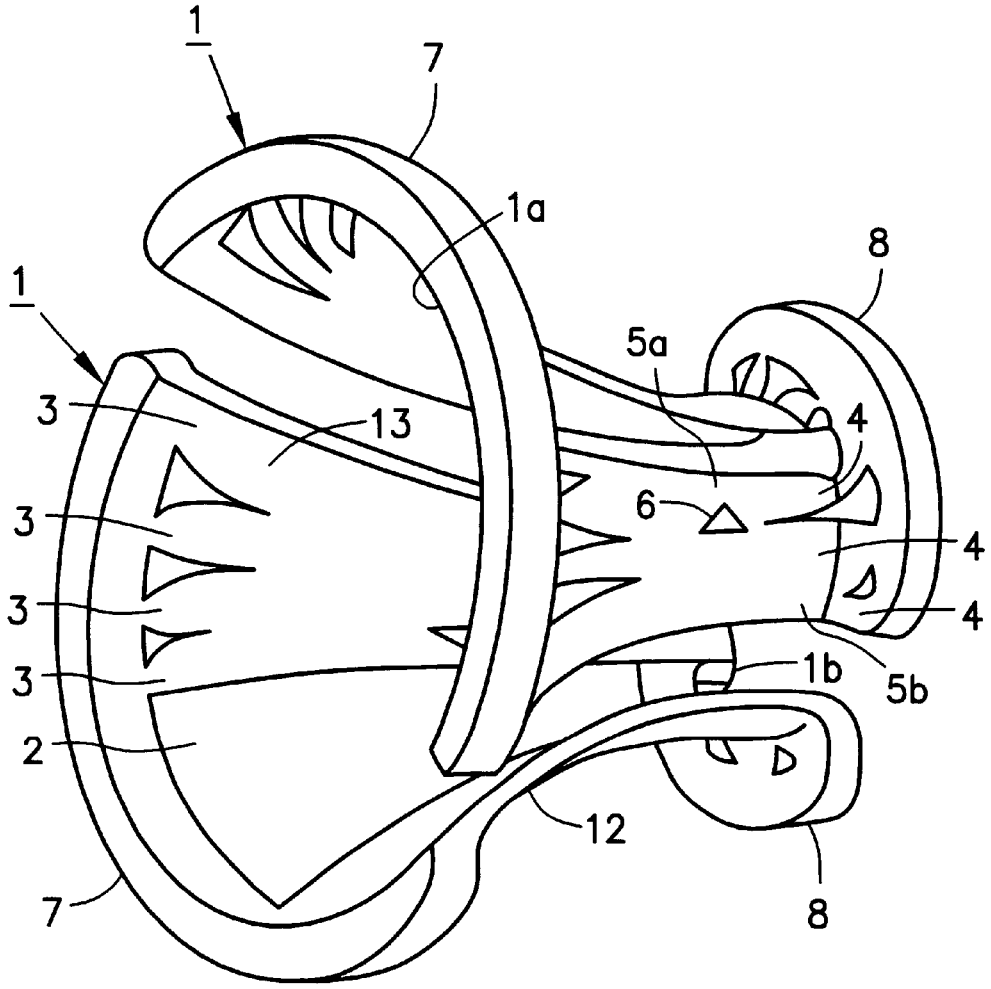
Fig. 2 Prior Art
FIG. 2 depicts a perspective view showing a pair of saddle type horizontal deflection coils according to a conventional design.
Figure 3A:
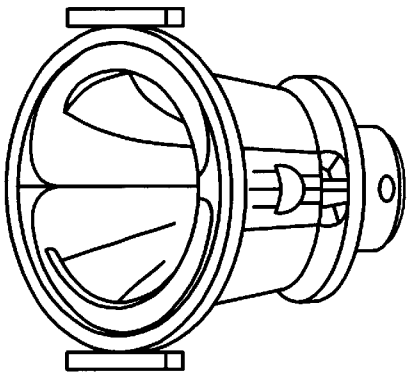
Fig. 3a Prior Art
FIGS. 3*a–d* depict a conventional method for correcting convergence on a CRT by placing a magnet on the horizontal coil.
Figure 3B:
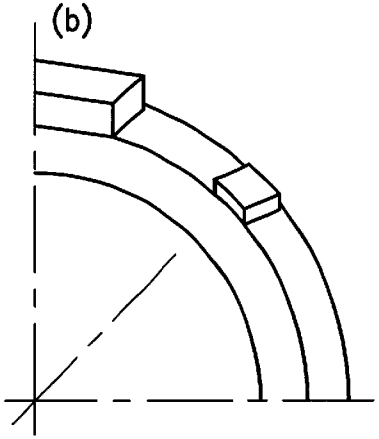
Fig. 3b Prior Art
Figure 3C:
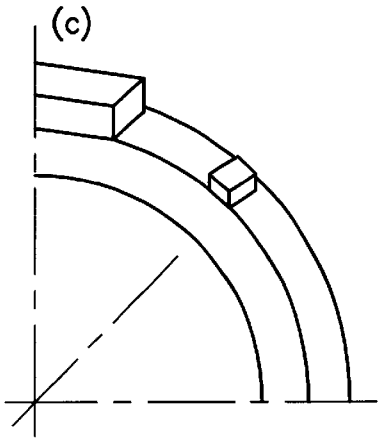
Fig. 3c Prior Art
Figure 3D:
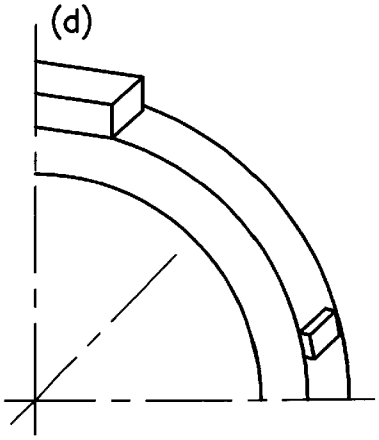
Fig. 3d Prior Art
Figure 5B:
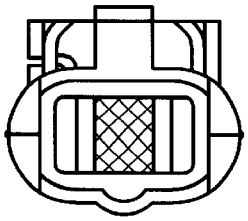
Fig. 5b Prior Art
FIG. 5*b* depicts the conventional correction device shown in FIG. 5*a* in a side view.
Figure 5A:
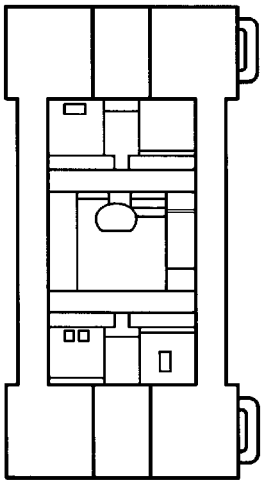
Fig. 5a Prior Art
FIG. 5*a* depicts a conventional correction device for correcting convergence on a CRT in a top view.
Figure 5E:
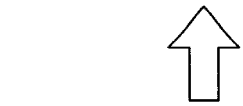
FIGS. 5*d–e* depict the before and after mis-convergence for the four parameters.
Figure 5E:
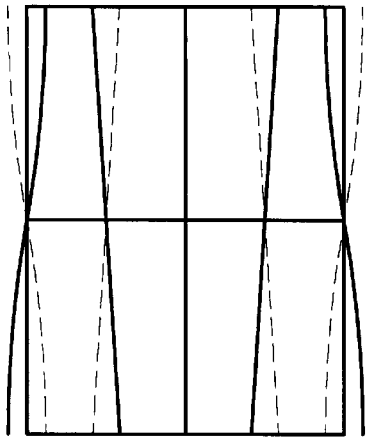
Figure 5D:
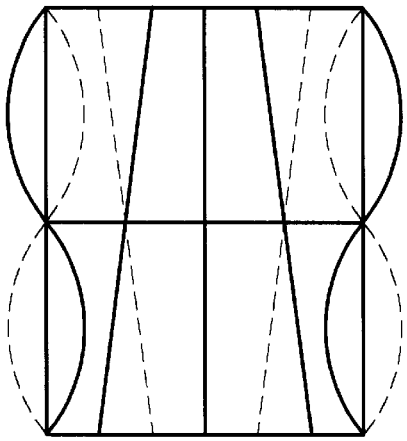
Figure 4:
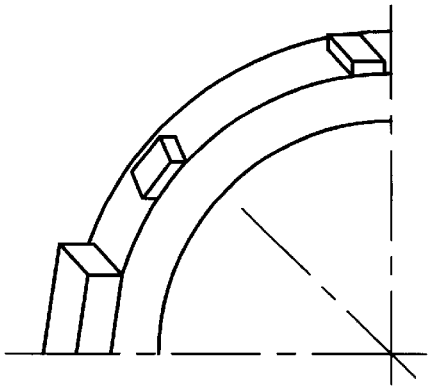
Fig. 4 Prior Art
FIG. 4 depicts a conventional method for correcting convergence on a CRT.
Figure 5C:
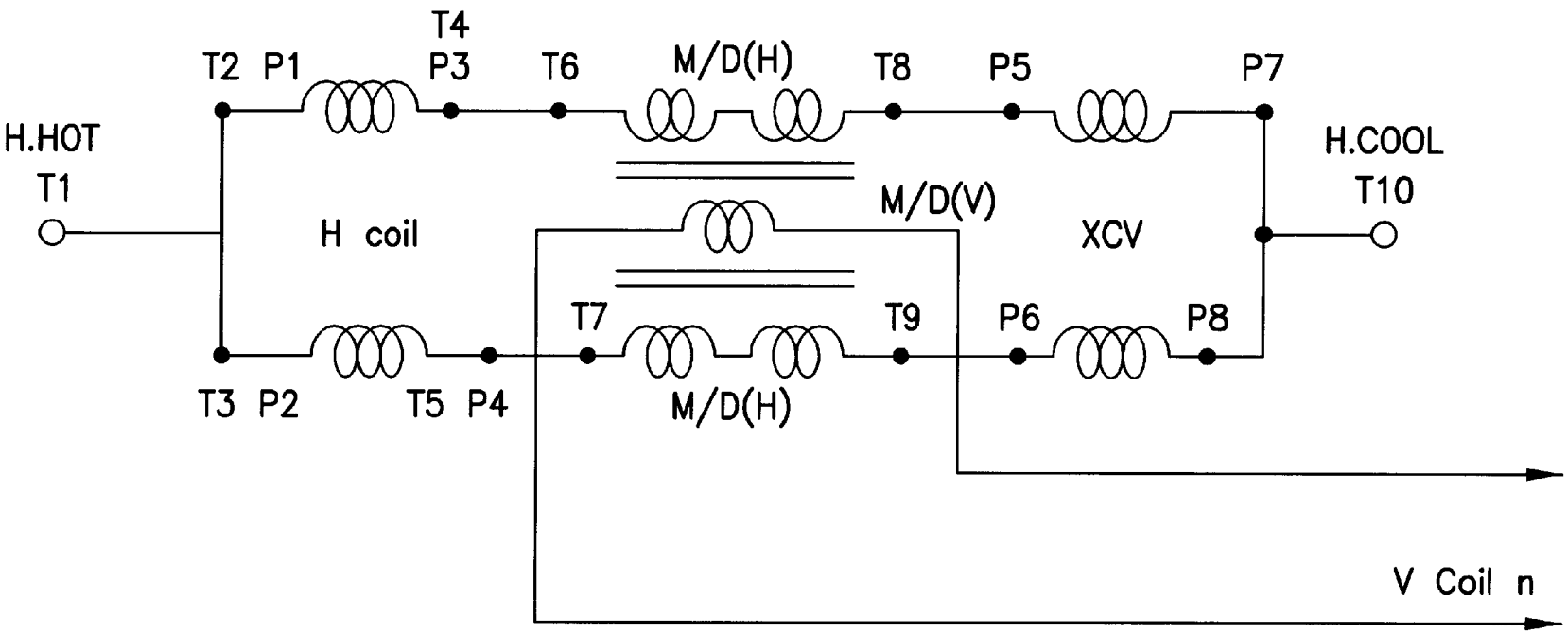
FIG. 5*c* depicts a circuit diagram of the conventional correction device shown in FIGS. 5*a* and 5*b*.
Figure 6B:
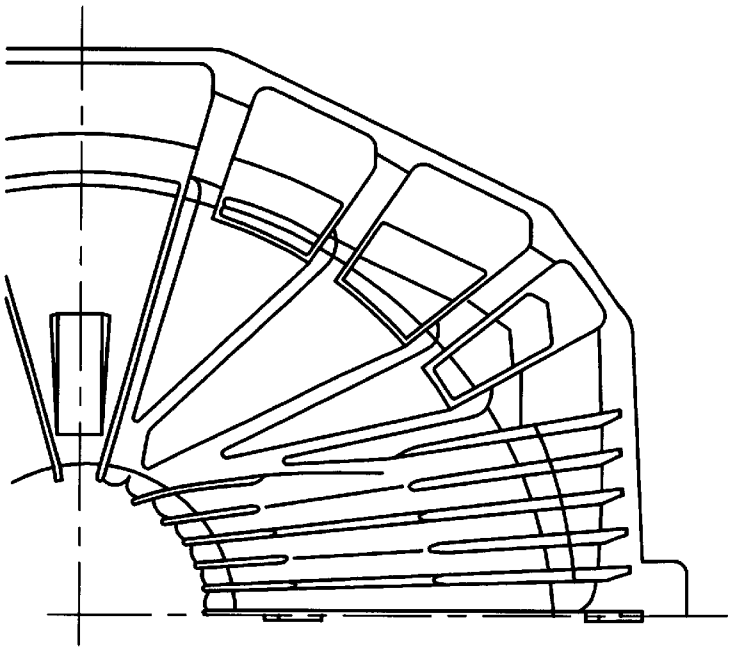
Fig. 6b Prior Art
FIG. 6*b* depicts a conventional shape of the horizontal coil.
Figure 6A:
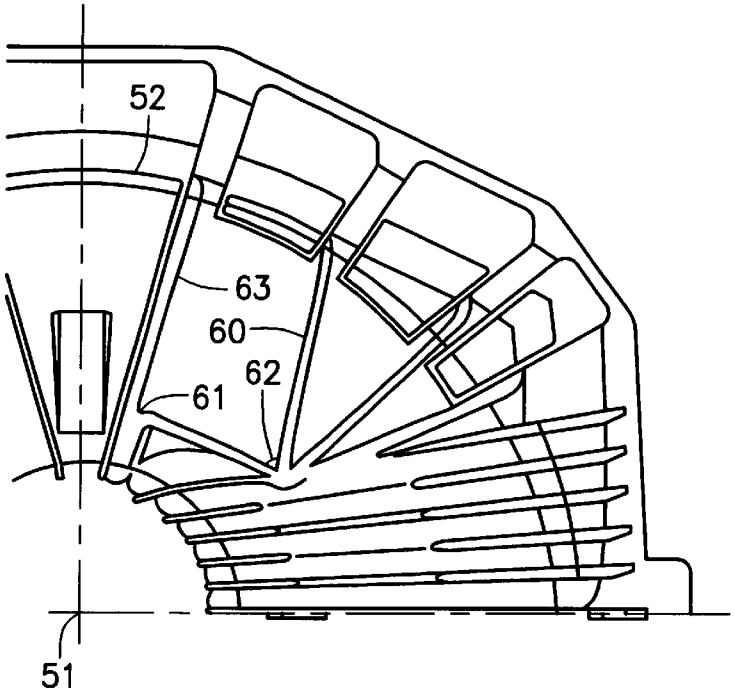
FIG. 6*a* depicts an exemplary embodiment of the present invention.

Referring to FIG. 6*a*, shown therein is an exemplary embodiment 50 of the horizontal coil of the present invention in cross section as viewed from the front side. In FIG. 6*a*, the wire route 60 can be seen, which runs from the center of the horizontal coil 51 (neck side) to the exterior 52 (funnel side). As evident in the conventional design, which is shown in FIG. 6*b*, the wire route in the conventional design runs from the neck side 51 of the coil directly at an angle to the funnel side 52 of the coil. Whereas, in the exemplary embodiment of the present invention as shown in FIG. 6*a*, the wire route 60 includes a first turning point 61 as the wire route runs from the neck side of the coil 51 so that the wire route 60 makes a right angle turn away from the adjacent wire 63 at the first turning point 61.

The exemplary embodiment of the present invention includes a second turning point 62, at which the wire route 60 makes a right angle turn so that at this point the wire route 60 runs essentially parallel to the adjacent wire 63.

Figure 7B:
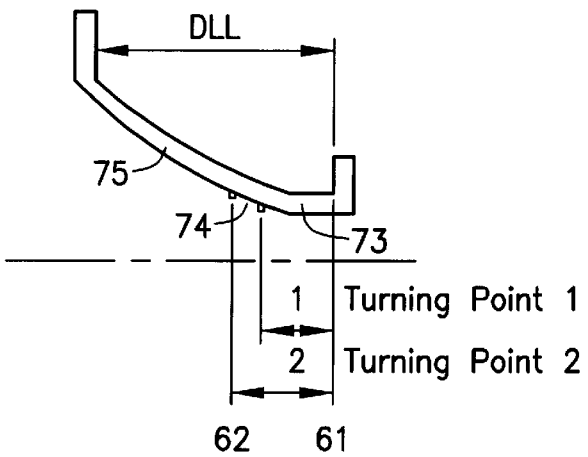
FIGS. 7*a–c* depict detailed drawings of an exemplary embodiment of the present invention.
Figure 7C:
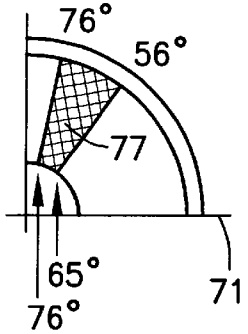
Figure 7A:
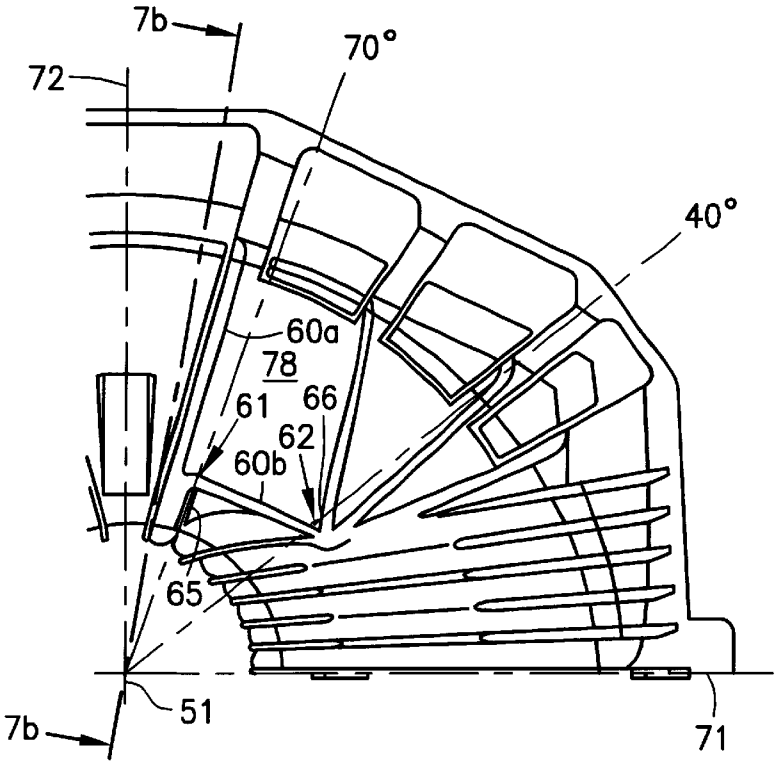

FIG. 7*a* depicts the same embodiment of the present invention in a more detailed view. As evident in FIG. 7*a*, the wire 60 splits at the first turning point 61. A first portion 60*a* of the wire continues straight while the remaining wires 60*b* make an approximately right angle away from the first portion 60*a*. For example, if the total wire includes about 8–10 wires, the first portion 60*a* includes about 5–6 wires and the remaining portion 60*b* includes about 3–4 wires.

As can be seen therein, the first turning point 61 lies on an angle measured from the x-axis 71 of approximately 70° and the second turning point 64 lies on an angle measured from the x-axis 71 of approximately 40°. Thus, the wire 60 extends outward from the neck side radially on an angle of approximately 70° measured from the center of the horizontal coil 51.

To maintain the wire in the desired wire route, the exemplary embodiment of the present invention depicted in FIG. 7*a* includes a pin 65 around which the wire is wrapped. A second pin 66 ensures the second turning point 62 is maintained in a similar fashion.

FIG. 7*b* depicts the location of the turning points 61, 62 in a side view along section B—B from FIG. 7*a*. Referring to FIG. 7*b*, which is not drawn to scale, the first turning point 61 is located at a point on the wire route 60 approximately 46%–55% of the total wire length measured from the neck side to the funnel side. For example, for a wire of approximately 64 mm., the first turning point is located at approximately 29.44 mm. to 35.20 mm. Thus, the length of the first section 73 is approximately 46% to 55% of the total length of the wire 60.

The second turning point is located at a point approximately 57% to 64% of the total length of the wire measured from the neck side to the funnel side. For example, for a wire of approximately 64 mm., the second turning point is located at approximately 36.48 mm to 40.96 mm. Thus, the length of the second section 74 of the wire route is approximately 2% to 18% of the total length of the wire 60.

The third section 75 then has a length of approximately 36% to 43% of the total length of the wire.

At the second turning point 62, the wire makes another turn of approximately 90° so that the wire 60 runs radially again and substantially parallel to the other wire 63. The second turning point 62 lies on an axial angle 76 measured from the x-axis 71 of about 40°.

FIG. 7*c* depicts a diagram of the area 77 in which the wire 60 must come from on which the turning points 61, 64 are located. Generally, the wire 60 must originate in the cross-hatched area 77. Thus, on the neck side the wire can originate at an angle anywhere from approximately 65° to approximately 76° as measured from the x-axis 71. The winding angle is therefore approximately 65° to approximately 76°. Moreover, the wire 60 must terminate at the funnel side at an angle anywhere from approximately 56° to approximately 76° as measured from the x-axis 71.

As evident in FIG. 7*a*, the wires 60*a* and 60*b* define a window 78 or space in the coil.

Figure 8A:
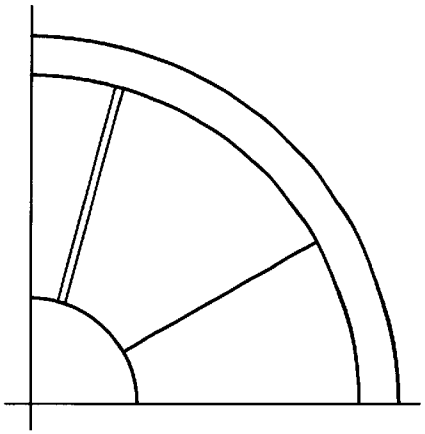
Fig. 8a Prior Art
FIG. 8*a* depicts a view of the front side of the horizontal coil according to a conventional design.
Figure 8B:
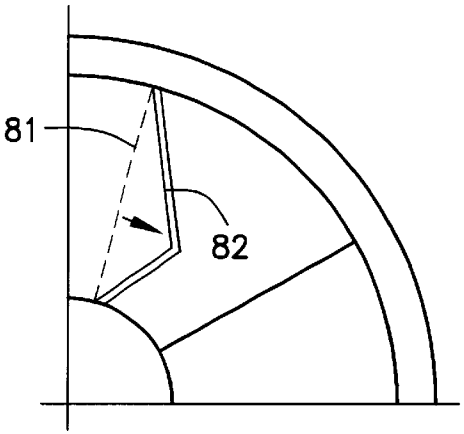
FIG. 8*b* depicts a view of the front side of the horizontal coil according to an exemplary embodiment of the present invention.

FIG. 8*a* depicts a view of the front side of a horizontal coil of a conventional design. FIG. 8*b* depicts an exemplary embodiment of the present invention. From these two figures one can determine the difference in the wire route 60. The dashed line 81 depicts the wire route in the conventional design. Wire route 82 of the present invention moves away from the conventional wire route 81.

Figure 9A:
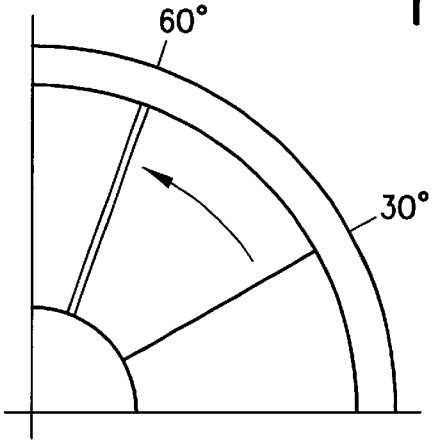
Fig. 9a Prior Art
FIG. 9*a* depicts a view of the front side of the horizontal coil according to a conventional implementation.
Figure 9B:
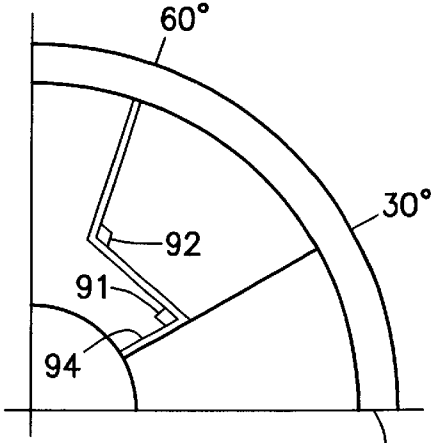
FIG. 9*b* depicts a view of the front side of the horizontal coil according to an exemplary embodiment of the present invention.

FIG. 9*a* depicts another view of the conventional design. FIG. 9*b* depicts the same view as seen in FIG. 9*a*, but for an alternative dual turning point embodiment of the present invention. In this exemplary embodiment, the first turning point 91 occurs on an radial of approximately 30° as measured from the x-axis 93. The second turning point 92 occurs at a radial of approximately 60° as measured from the x-axis 93. In this exemplary embodiment, the turning points 91, 92 cause the wire route to be essentially opposite to that shown in FIG. 7*a*. In this exemplary embodiment, the wire 94 must originate at an angle of approximately 30° on the neck side and terminate at an angle of approximately 60° at the funnel side.

In addition, the wire locus mast has an X-axis element. The wire locus from turning point 1 to turning point 2 should be in the horizontal direction as compared with regular wires. This wire crosses at right angles based on other wires.

The present invention corrects middle convergence error which can be explained by Fourier coefficients. There are some wires between turning point 1 and turning point 2, which have winding angles from 40° through 70°. The winding distribution of the present invention affects the horizontal coil magnetic field as compared to the conventional horizontal coil winding distribution.

Changing the winding distribution to adjusting convergence error is known, however, the conventional method is to move some wires from winding angle A to B. This can be seen in FIG. 9*a*, in which the winding angle is moved from 30° to 60°. This conventional method affects just one winding angle. In contrast, the present invention affecting two winding angles. The winding angle is from 40 degrees through 70 degrees. This means that A7/A1 of the Fourier coefficient value is modified (+) thereby reducing convergence error S2 and S3. Also, the A5/A1 Fourier coefficient values is also modified (−) thereby reducing the convergence error S1 simultaneously.

The present invention affects just one portion, which is a relatively small modification. As a result, the other. convergence parameters do not change. Of course, PQV remains unchanged.

Finally, the present invention achieves PQV=0, S1, S2 and S3=0 with requiring a separate correction device. The present invention makes it easy to determine the correction required to move the turning point location along the horizontal coil length direction.

What is claimed is:

1. A deflection yoke comprising a horizontal coil having a neck side and a funnel side, and including:

a window being disposed in the horizontal coil; and a bundle of at least two wires, said bundle of at least two wires defining together with the horizontal coil, an outline of said window, said bundle of at least two wires consisting of at least a first wire and a second wire, said bundle of at least two wires originating at a first predetermined angle on the neck side of the horizontal coil and splitting apart from one another into a first portion of at least the first wire and a second portion of at least the second wire at a first turning point, wherein the first portion of at least the first wire is rerouted at a second predetermined angle on the funnel side of the horizontal coil, the second portion of at least the second wire turns away from the first portion of at least the first wire, wherein the second portion of at least the second wire turns at a second turning point, disposed at a third predetermined angle, so that the second portion of at least the second wire is rerouted at a fourth predetermined angle on the funnel side, and wherein at least two winding angles of said bundle of at least two wires are modified at said first turning point and said second turning point, respectively, to correct middle convergence error in a CRT.

2. The deflection yoke according to claim 1, wherein the first predetermined angle lies within a range from sixty-five degrees (65°) to seventy-six degrees (76°) when measured from a horizontal axis through a cross-section of the horizontal coil.

3. The deflection yoke according to claim 1, wherein the second predetermined angle lies within a range from sixty-five degrees (65°) to seventy-six degrees (76°) when measured from a horizontal axis through a cross-section of the horizontal coil.

4. The deflection yoke according to claim 1, wherein the third predetermined angle is forty degrees (40°) when measured from a horizontal axis through a cross-section of the horizontal coil.

5. The deflection yoke according to claim 1, wherein the fourth predetermined angle lies within a range from fifty-six degrees (56°) to seventy-six degrees (76°) when measured from a horizontal axis through a cross-section of the horizontal coil.

6. The deflection yoke according to claim 1, wherein the first turning point is disposed at a location on the first portion of forty-six percent (46%) to fifty-five percent (55%) of a total length of the first portion from the neck side.

7. The deflection yoke according to claim 1, wherein the second turning point is disposed at a location on the second portion of fifty-seven percent (57%) to sixty-four percent (64%) of a total length of the second portion from the neck side.

8. The deflection yoke according to claim 1, further comprising a first pin around which the second portion is wound thereby establishing the first turning point.

9. The deflection yoke according to claim 8, further comprising a second pin around which the second portion is wound thereby establishing the second turning point.

10. The deflection yoke according to claim 1, wherein the first predetermined angle lies within a range from thirty degrees (30°) to forty degrees (40°) when measured from a horizontal axis through a cross-section of the horizontal coil.

11. The deflection yoke according to claim 1, wherein the second predetermined angle lies within a range from thirty degrees (30°) to forty degrees (40°) when measured from a horizontal axis through a cross-section of the horizontal coil.

12. The deflection yoke according to claim 1, wherein the third predetermined angle is sixty degrees (60°) when measured from a horizontal axis through a cross-section of the horizontal coil.

13. The deflection yoke according to claim 1, wherein the fourth predetermined angle lies within a range from fifty-six degrees (56°) to sixty degrees (60°) when measured from a horizontal axis through a cross-section of the horizontal coil.

* * * * *

UNITED STATES PATENT AND TRADEMARK OFFICE

CERTIFICATE OF CORRECTION

PATENT NO. : 6,278,348 B1
APPLICATION NO. : 09/443762
DATED : August 21, 2001
INVENTOR(S) : Yoshihiko Usami It is certified that error appears in the above-identified patent and that said Letters Patent is hereby corrected as shown below:

Column 4, line 36, change “related” to --rerouted--.
Column 7, line 12, change “an” to --a--.
Column 7, line 37, change “affecting” to --affects--.
Column 7, line 42, change “values” to --value--.
Column 7, line 49, change “with” to --without--.

Signed and Sealed this

Twenty-seventh Day of May, 2008

JON W. DUDAS
*Director of the United States Patent and Trademark Office*